US005330350A

United States Patent [19]

Tegtmeier

[11] Patent Number: 5,330,350

[45] Date of Patent: Jul. 19, 1994

[54] RECIPROCATING GRATE COOLER

[75] Inventor: Gert Tegtmeier, Oelde, Fed. Rep. of Germany

[73] Assignee: Krupp Polysius AG, Fed. Rep. of Germany

[21] Appl. No.: 907,383

[22] Filed: Jul. 1, 1992

[30] Foreign Application Priority Data

Jul. 9, 1991 [DE] Fed. Rep. of Germany ..... 9108470

[51] Int. Cl.[5] ..... F23D 15/02

[52] U.S. Cl. ..... 432/77; 432/78; 432/238; 432/244; 110/281

[58] Field of Search ..... 432/77, 78, 81, 238, 432/244; 110/281

[56] References Cited

U.S. PATENT DOCUMENTS 3,358,385 12/1967 Maberry ..... 432/77
4,778,381 10/1988 Heinemann et al. ..... 432/77
5,149,266 9/1992 Heinemann et al. ..... 62/63

*Primary Examiner*—Henry C. Yuen
*Attorney, Agent, or Firm*—Learman & McCulloch

[57] ABSTRACT

The invention relates to a reciprocating grate cooler in which the drive arrangement is enclosed by a drive housing, the interior of which is closed off so as to be airtight against the atmosphere, but by contrast has a pressure equalization connection to the interior of the cooler housing. Such a reciprocating grate cooler is distinguished by a substantially reduced expenditure for the sealing of the cooler housing and a high degree of freedom from disruption.

7 Claims, 3 Drawing Sheets

RECIPROCATING GRATE COOLER

Figure 1:
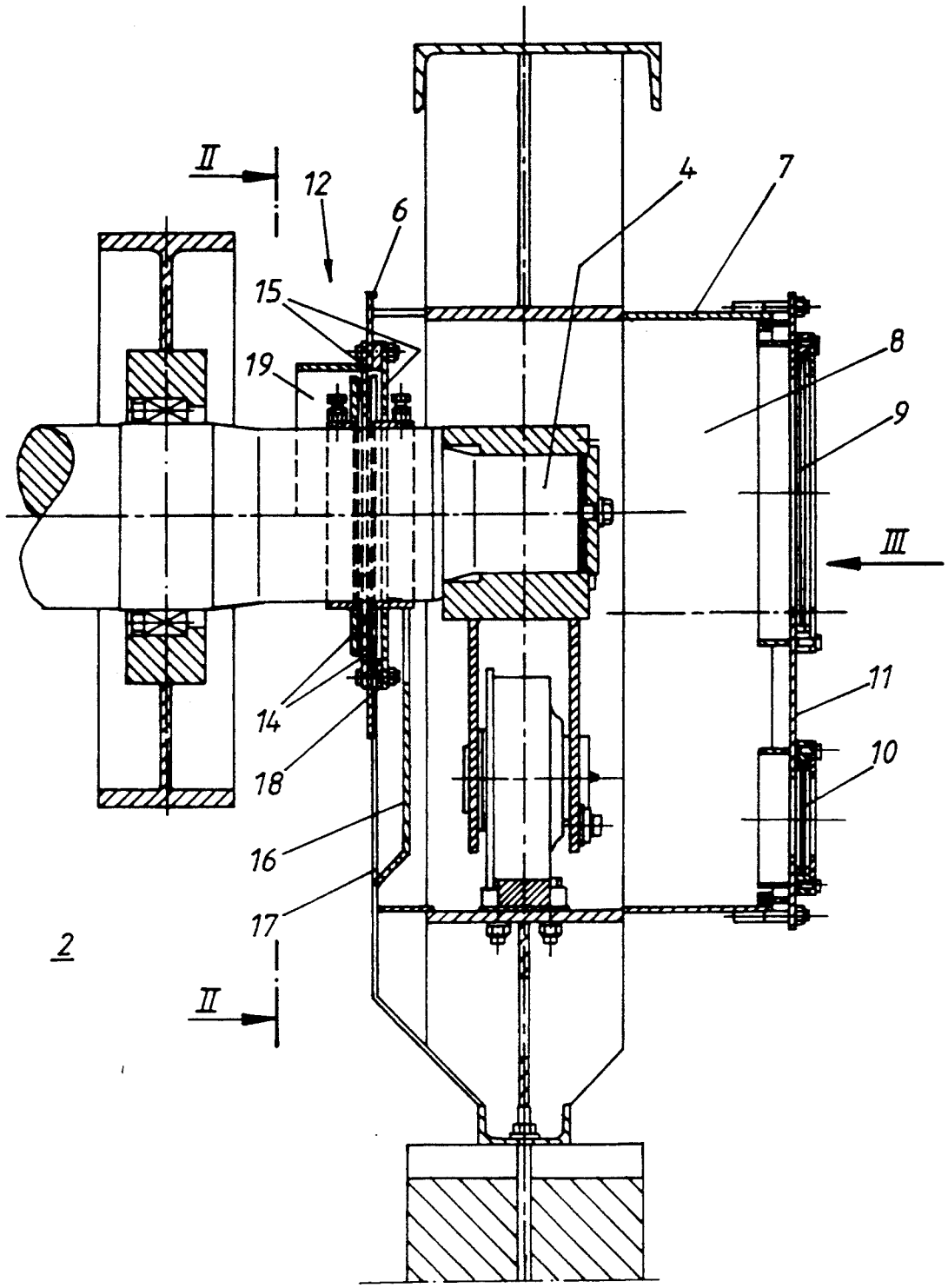

The invention relates to a reciprocating grate cooler.

BACKGROUND OF THE INVENTION

Since in a reciprocating grate cooler the cooling air is delivered through the interior of the cooler housing located below the grate elements, this interior of the cooler housing is under positive air pressure. A drive mechanism which serves to produce the thrust motion of the grate elements is usually arranged outside the cooler housing and passes by means of a driving shaft through an elongated opening which is provided in a side wall of the cooler housing.

In order to prevent the escape of cooling air and the discharge of powdered particles of the cooled material through this elongated opening, in the previously known constructions special measures have been provided for dustproof and airtight sealing of this opening.

In a known construction of this type a sealing plate which is firmly connected to the driving shaft and therefore movable with it is pressed by spring force against a stationary sealing plate which is connected to the side wall of the cooler housing. If the movable sealing plate is moved to and fro by the driving shaft during the thrust motion, then the sealing plates which lie under spring pressure against one another are constantly rubbed against one another. In order to keep the wear on the abraded rubbing surfaces within limits, attempts are made continuously to press grease between the rubbing surfaces by means of a central lubricating arrangement.

The sealing between the driving shaft and the movable sealing plate is achieved in this known construction by a stuffing box which is also pressed by spring force against the driving shaft and the sealing plate. In order to keep the movable sealing plate in its position on the driving shaft it is guided through a guide strip.

The principal disadvantage of this known construction is the severe wear on the sealing elements which are movable relative to one another, and also the high costs associated with the central lubrication as well as the necessity for frequent maintenance. A particularly unfavourable aspect is that disruptions to this sealing system (for instance failure of the central lubrication caused by contaminated grease) can lead to a shutdown of the reciprocating grate cooler and thus in certain circumstances to a temporary failure of the entire kiln installation.

The object of the invention, therefore, is to avoid these disadvantages and to provide a reciprocating grate cooler of such construction that the costs associated with the airtight and dustproof sealing of the cooler housing are substantially reduced and a high degree of freedom from disruption of the installation is produced.

SUMMARY OF THE INVENTION

In the reciprocating grate cooler according to the invention the drive mechanism is enclosed by a drive housing, the interior of which is closed off so as to be airtight with respect to the atmosphere but by contrast has a pressure equalisation connection to the interior of the cooler housing.

Since the invention produces a pressure equalisation connection between the interior of the cooler housing and the interior of the drive housing, it deliberately—in contrast to the known construction described in the introduction—dispenses with the need for an airtight seal for the elongated opening provided in the side wall of the cooler housing and through which the driving shaft passes. According to the invention the interior of the drive housing is closed off so as to be airtight against the atmosphere (i.e. the drive mechanism is encapsulated), which can be achieved in a simple manner by means of a cover which is preferably provided with a window through which the drive mechanism can be observed.

According to the invention, in the region of the elongated opening in the side wall of the cooler housing there is provided not an airtight closure but preferably a labyrinth seal which operates largely without wear and practically precludes the penetration of dust from the interior of the cooler housing into the drive housing but permits a pressure equalisation connection between the interiors of the cooler housing and of the drive housing.

The air pressure in the interior of the cooler housing normally always corresponds to that in the interior of the drive housing so that overflowing of the air from the cooler housing into the drive housing does not occur. Consequently, in the absence of any significant air currents there can be no transport of dust from the cooler housing to the drive housing. Merely in the event of pressure fluctuations in the cooler slight air currents are produced in one or the other direction until the pressure equalisation is restored. However, with these equalisation currents, which are in any case small, the labyrinth seal prevents dust from being transported into the drive housing.

By contrast with the known construction described in the introduction, the solution according to the invention is distinguished above all by the omission of the costly central lubrication, which not only lowers the cost of the production and installation but also produces a considerable saving of lubricant in operation.

Furthermore, as a result of the omission of the central lubrication the freedom from disruption of the reciprocating grate cooler and thus of the entire kiln installation is substantially improved. The labyrinth seal, which is used according to the invention purely as a dust seal, operates almost without wear and maintenance.

The encapsulation of the drive mechanism also produces an improved protection of the hydraulic cylinders and thus an increase in the operational life of piston rods and seals.

THE DRAWINGS

Figure 2:
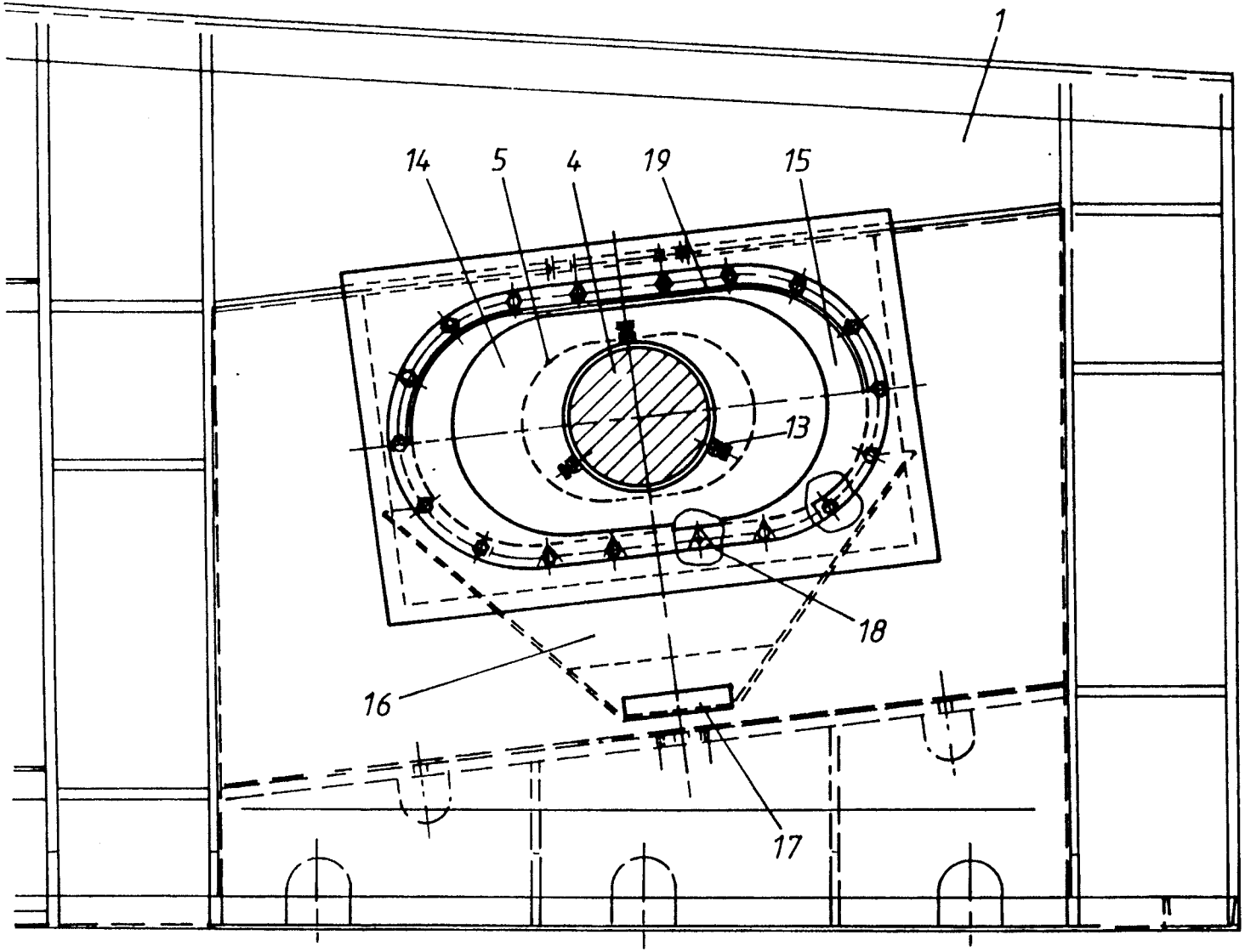
Figure 3:
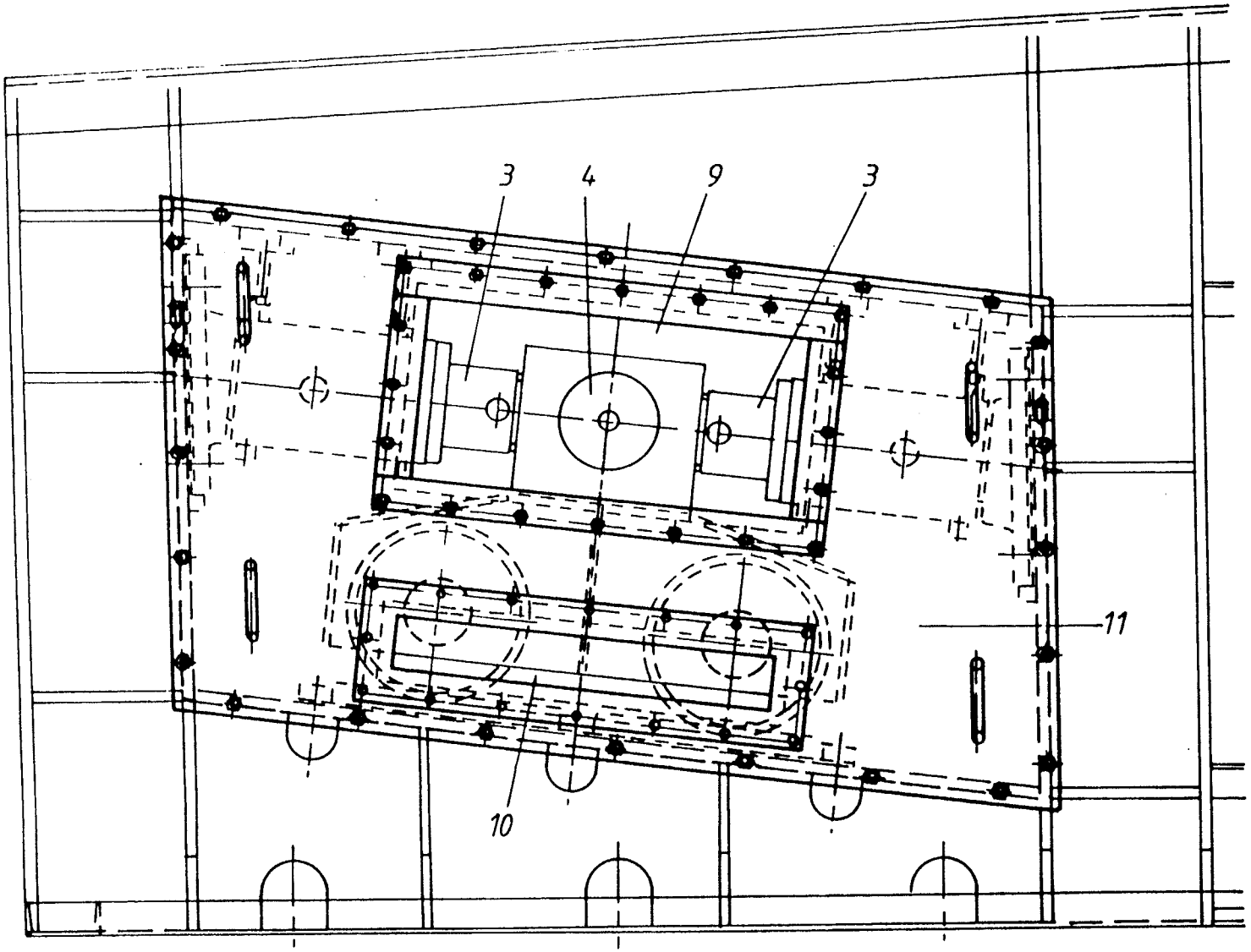

One embodiment of the invention is illustrated in the drawings, in which:

FIG. 1 is a cross-section through the parts of a reciprocating grate cooler which are essential for the understanding of the invention, FIG. 2 is a cross-section along the line II—II in FIG. 1, FIG. 3 shows a view in the direction of the arrow III in FIG. 1.

THE DISCLOSED EMBODIMENT

The reciprocating grate cooler illustrated in a cutaway view contains a cooler housing 1 of which the interior 2 located below the grate elements (which are not shown) is under positive air pressure. A drive mechanism 3 formed by hydraulic cylinders is arranged outside the cooler housing 1 and serves to produce the thrust motion of the grate elements. A reciprocable driving shaft 4, which extends through an elongated opening 5 in the side wall 6 of the cooler housing 1, forms part of this drive mechanism 3.

The drive mechanism 3 is enclosed by a drive housing 7, the interior of which is closed off so as to be airtight against the atmosphere by a cover 11 which is provided with two windows 9, 10, but on the other hand the interior 8 of the drive housing 7 has a pressure equalisation connection to the interior 2 of the cooler housing 1.

For this purpose the passage of the driving shaft 4 through the elongated opening 5 in the side wall 6 of the cooler housing 1 is sealed so as to be dustproof (but not airtight) by means of a labyrinth seal 12. Thus this labyrinth seal permits a pressure equalisation connection between the interior 2 of the cooler housing 1 and the interior 8 of the drive housing 7.

The labyrinth seal 12 includes two oval sealing elements 14 which are fixed on the driving shaft 4 with the aid of three setscrews and are movable with the driving shaft 4 in the direction of thrust. The labyrinth seal 12 also contains two stationary sealing elements 15 which are firmly connected to the side wall 6 of the cooler housing 1. The sealing elements 14, 15 are interleaved with one another and spaced a small distance apart in the manner shown in the drawing.

Below the labyrinth seal 12 there is provided a hopper 16 which has at its lower end an opening 17 through which the dust falling out of the labyrinth seal 12 is delivered back to the interior 2 of the cooler housing 1. Located between the two fixed sealing elements 15 are spacers 18 which are triangular in the lower region and which form a slot which is open downwards through which the dust which has penetrated into the labyrinth seal 12 as well as any particles of clinker can fall into the hopper 16.

In order so far as possible for clinker falling down through the cooling grate to be kept away from the region of the labyrinth seal 12, a guard plate 19 is provided above the driving shaft 4 (i.e. above the part of the labyrinth seal 12 located in the interior 2 of the cooler housing 1).

As a variant of the embodiment which is illustrated and described, it is possible to construct the labyrinth seal 12 with only one single fixed sealing element 15 arranged between the movable sealing elements 14. The second (inner) fixed sealing element 15 and the spacers 18 are omitted in this variant.

A labyrinth seal of the type described can also be used for sealing the openings on the crossbeams of the movable frame whose mounting is also accommodated in a housing which is airtight towards the exterior.

I claim:

1. A reciprocating grate cooler construction having a cooler housing under positive air pressure; a drive mechanism external of said housing and having a reciprocable drive shaft extending through an elongate opening in a side wall of said cooler housing; an air tight drive housing enclosing said drive mechanism and encircling said shaft, said drive housing being in communication with the interior of said cooler housing via said opening; and a pressure equalization connection coupling said drive housing to said cooler housing at said opening to enable substantially equal pressure to be maintained within said cooler housing and said drive housing.

2. The construction according to claim 1 wherein said pressure equalization connection comprises a labyrinth seal.

3. The construction according to claim 2 wherein said labyrinth seal comprises at least two sealing elements fixed on said shaft for movement therewith and at least one stationary sealing element fixed to said side wall of said cooler housing.

4. The construction according to claim 3 wherein said drive housing includes a hopper at a level below that of said labyrinth seal and in communication with the interior of said cooler housing and through which dust falling from the labyrinth seal may be returned to the interior of said cooler housing.

5. The construction according to claim 2 including a guard plate overlying said labyrinth seal and positioned within said cooler housing.

6. The construction according to claim 2 wherein said labyrinth seal comprises interleaved sealing elements carried by said drive shaft and said cooler housing, said sealing elements being adjacent and spaced from one another a distance to provide a substantially dust tight, but not air tight, seal.

7. The construction according to claim 1 wherein said drive housing includes at least one transparent window.

* * * * *